US008857752B2

(12) United States Patent
Saito et al.

(10) Patent No.: US 8,857,752 B2
(45) Date of Patent: Oct. 14, 2014

(54) WIRE BODY TAKE-UP DEVICE AND WIRE BODY TAKE-UP METHOD

(75) Inventors: Satoshi Saito, Tokyo (JP); Toshinobu Harada, Tokyo (JP); Makoto Kageyama, Tokyo (JP); Masahiro Ishimi, Tokyo (JP); Teruhiko Fukuda, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 670 days.

(21) Appl. No.: 13/130,416

(22) PCT Filed: Nov. 20, 2009

(86) PCT No.: PCT/JP2009/006276

§ 371 (c)(1),
(2), (4) Date: Aug. 2, 2011

(87) PCT Pub. No.: WO2010/058597

PCT Pub. Date: May 27, 2010

(65) Prior Publication Data

US 2011/0284679 A1 Nov. 24, 2011

(30) Foreign Application Priority Data

Nov. 21, 2008 (JP) ..... 2008-297443

(51) Int. Cl.
*B65H 54/28* (2006.01)

(52) U.S. Cl.
CPC ..... *B65H 54/2851* (2013.01); *B65H 2701/31* (2013.01); *B65H 54/286* (2013.01); *B65H 2701/3914* (2013.01)
USPC ..... 242/478.2; 242/484

(58) Field of Classification Search
CPC .... B65H 54/04; B65H 54/12; B65H 54/2803; B65H 54/2851; B65H 54/2854; B65H 54/2857; B65H 54/286
USPC ..... 242/476.7, 476.9, 477, 478.2, 484
See application file for complete search history.

(56) References Cited

FOREIGN PATENT DOCUMENTS

| | | |
|---|---|---|
| JP | 10-316307 A | 12/1998 |
| JP | 2002-211841 A | 7/2002 |
| JP | 2002-241053 A | 8/2002 |

OTHER PUBLICATIONS

Machine Translation of JP 2002-241053 A, Aug. 28, 2002.*
Machine Translation of JP 2002-211841 A, Jul. 31, 2002.*
International Search Report w/translation from PCT/JP2009/006276 datd Feb. 16, 2010 (2 pages).
Patent Abstracts of Japan; Publication No. 10-316307 dated Dec. 2, 1998 (1 page).

* cited by examiner

*Primary Examiner* — William E Dondero
(74) *Attorney, Agent, or Firm* — Osha Liang LLP

(57) ABSTRACT

A line body take-up device takes up the line body around an outer circumferential surface of a winding body of the bobbin at a predetermined take-up pitch with aligned winding while moving the bobbin to traverse. A winding position of the line body is sequentially changed in the axial direction, to form a wound line body layer; inverting the direction of traverse when the line body is wound up to an inner edge of the flange of the bobbin; and winding the line body around an outer circumferential surface of the previous wound line body layer, formed by winding the line body so far, in an aligned manner at the take-up pitch to form a subsequent wound line body layer, by use of a line body turn part by which the previous wound line body layer is transferred to the subsequent wound line body layer; the line body take-up device.

13 Claims, 14 Drawing Sheets

WIRE BODY TAKE-UP DEVICE AND WIRE BODY TAKE-UP METHOD

TECHNICAL FIELD

The present invention relates to a line body take-up device and a line body take-up method usable for taking up a line body having, for example, a rectangular cross-section such as a flat electric line or the like, with aligned winding.

BACKGROUND ART

Conventionally, as a device for taking up a line body as mentioned above, a take-up device including means for pressing the line body while constantly holding the line body with a pair of flange rollers and a line press block and outputting a traverse inversion signal using a function of detecting that a layer of the line body is put on another layer of the line body has been proposed (Patent Document 1). A take-up control device for feeding the line body pitch by pitch and taking up the line body around a take-up bobbin with aligned winding has also been proposed (Patent Document 2).

Recently, electric devices, industrial motors and automobile driving motors have progressively become more energy-saving, more compact and higher in performance. In accordance with this, flat electric lines which can be taken up at a high density have been used more widely. For taking up a flat electric line fed from a flat electric line production apparatus, it is required to wind the flat electric line around a bobbin in a completely aligned manner. It is more preferable that the amount of the flat electric line wound around the bobbin is larger.

When the ratio of the width and the thickness (width/thickness) of a line body formed of the flat electric line having a rectangular cross-section is not large (especially when width/thickness<2), in order to increase the amount of the electric line wound around the bobbin (200 kg or more where the conductor is copper), the external shape of the bobbin needs to be enlarged. However, as the external shape of the bobbin is enlarged, the number of winds of the line body taken up around the bobbin in one layer, and also the number of wound layers around the bobbin, are increased.

More specifically, it is assumed here that a flat enamel line having a rectangular cross-section with a thickness T of 1 mm, a width W of 1.56 mm, and a corner chamfering R of 0.3 mm and using copper as a conductor is taken up around a bobbin formed of a cable drum according to the Japanese Design Patent Registration No. 1105143. When 250 kg of the line body is taken up around the bobbin, the number of winds in each layer is about 179 and the number of wound layers is 72.

However, it is difficult to realize completely aligned winding by the conventional art with the take-up device and the take-up control device described above because of the level of precision in terms of the position or shape of the flange of the bobbin and the level of precision in terms of the width of the line body.

In detail, a take-up bobbin is generally formed of wood, iron or a resin, but it is difficult to mold a bobbin without any variance in the position or shape of the flange or the variance in the thickness. In addition, the bobbin is used repeatedly and the flange of the bobbin is distorted as being used repeatedly.

For example, when the position of the flange of the bobbin is shifted by 0.8 mm, the line body partially has a clearance C of 0.8 mm at an inner edge of the flange or the bobbin is short of the area for winding the line body.

When the thickness of the flange of the bobbin is changed by 0.8 mm, the following occurs. When the bobbin is set to a take-up device, the position of the flange of the bobbin is shifted by 0.8 mm. Therefore, the traverse position does not conform to the bobbin. As a result, the line body wound around the bobbin has a clearance C of 0.8 mm throughout the circumference of the bobbin or the bobbin is short of the area for winding the line body.

In general, it is rare that the effective take-up width of a winding body of the bobbin around which the line body is to be taken up is an integral multiple of the width of the line body. This means that when the line body is taken up with aligned winding with no gap, a clearance C smaller than the width of the line body is made between the flange and the line body. When such a take-up method is used, a clearance C between the flange and the line body (hereinafter, referred to simply as the "clearance C") is made or the bobbin is short of the area for winding the line body in most of the cases because of the variance in the position or shape of the flange or the change of the width of the line body.

When there is a clearance C at the inner edge of the flange and the clearance C is larger than a predetermined value, a part of the line body, which should be in the next layer, falls into the clearance C. As a result, the completely aligned winding cannot be realized (see FIG. 6). When the bobbin is short of the area for winding the line body, a part of the line body which should be in the underlying layer is put on the underlying layer as if this part was included in the next layer. In this case also, the completely aligned winding cannot be realized.

Even when a gap Δ is provided between adjacent winds of the line body in order to prevent a clearance C from being made at the inner edge of the flange, the size of the gap Δ between the adjacent winds of the line body needs to be chosen appropriately. Otherwise, there occurs a problem that a part of the line body in the next layer falls into the gap between the adjacent winds of the line body and so the completely aligned winding cannot be realized (see FIG. 7 (*b*)).

The width of the line body changes due to the production variance of the conductor and the insulating cover. For example, when the line body is to be taken up with 179 winds in one layer, a change of the width of 0.01 mm amounts to a change of 1.79 mm in total, which is larger than the width of the line body. When such a change occurs, the completely aligned winding cannot be realized with the conventional art.

CITATION LIST

Patent Literature

Patent Document 1: Japanese Laid-Open Patent Publication No. 2002-241053

Patent Document 2: Japanese Laid-Open Patent Publication Hey No. 10-316307

SUMMARY OF INVENTION

One or more embodiments of the present invention provide a line body take-up method capable of taking up a line body with completely aligned winding even at the inner edge of a flange of a bobbin.

One or more embodiments of the present invention are directed to a line body take-up device for taking up a line body around a bobbin having a flange at each of two ends thereof in an axial direction, by taking up the line body around an outer circumferential surface of a winding body of the bobbin at a predetermined take-up pitch with aligned winding while moving the bobbin to traverse, so that a winding position of the line body is sequentially changed in the axial direction, to form a wound line body layer; inverting the direction of traverse when the line body is wound up to an inner edge of the flange of the bobbin; and winding the line body around an outer circumferential surface of the previous wound line body layer, formed by winding the line body so far, in an aligned manner at the take-up pitch to form a subsequent wound line body layer, by use of a line body turn part by which the previous wound line body layer is transferred to the subsequent wound line body layer. The line body take-up device comprises a first line body winding guide mechanism including a pair of roller units respectively corresponding to two transverse directions and each including an outer circumferential press roller part for contacting and pressurizing an outer circumferential surface of a line body winding part, which is being wound in a layer in an aligned manner, and a flange roller part for contacting a side surface of the line body winding part on a forward side in the traverse direction, the outer circumferential press roller part and the flange roller part being integrated together, wherein the first line body winding guide mechanism selects one of the pair of roller units in accordance with the traverse direction to be used and guides the line body to the outer circumferential surface of the winding body. The line body take-up device also comprises a second line body winding guide mechanism including a first press block by which when the line body winding part approaches the vicinity of the flange of the bobbin, a main body side surface of the first press block contacts an inner side surface of the flange and a main body tip surface of the first press block contacts and pressurizes the outer circumferential surface of the wound line body layer; when the subsequent wound line body layer starts to be wound by use of the line body turn part, the main body tip surface of the first press block contacts and pressurizes an outer circumferential surface of the line body turn part in the subsequent wound line body layer; and when the traverse direction is inverted, the main body tip surface of the first press block contacts and pressurizes the outer circumferential surface of the previous wound line body layer so that the main body side surface of the first press block contacts a side surface of the line body turn part in the subsequent wound line body layer on the forward side in the inverted traverse direction; a second press block, incorporated in a main body of the first press block, with which until the line body winding part approaches the vicinity of the flange of the bobbin, a tip surface of the second press block is generally flush with the main body tip surface of the first press block; when the subsequent wound line body layer starts to be wound at the inner edge of the flange, the second press block protrudes from the main body tip surface of the first press block to press the outer circumferential surface of the previous wound line body layer by means of the tip surface of the second press block, and also a side surface of the second press block contacts a side surface of the line body winding part in the subsequent wound line body layer on a backward side in the traverse direction; and traverse inversion signal transmission means for, when the first press block is put on the subsequent wound line body layer at the inner edge of the flange, transmitting a traverse inversion signal. The line body take-up device further comprises take-up pitch setting means for setting the take-up pitch to 1.01 to 1.25 times a width of the line body.

In an embodiment of the present invention, the flange roller part may have a structure of pressing the side surface of the line body winding part on the forward side in the traverse direction in an opposite direction to the traverse direction in the vicinity of the flange so that, when the line body winding part is inadvertently shifted in the traverse direction, the flange roller part contacts the side surface of the line body winding part on the forward side in the traverse direction and/or a space for winding the line body turn part is provided with certainty at the inner edge of the flange.

In an embodiment of the present invention, for taking up the line body around the outer circumferential surface of the winding body, the take-up pitch setting means may set the take-up pitch at which the bobbin is moved to traverse, after a space for winding the line body turn part is provided with certainty.

In an embodiment of the present invention, the line body take-up device may further comprise detection means for detecting a position of each of the two flanges of the bobbin and a distance between the flanges; and traverse position setting means for setting a traverse position formed of a start position at which the line body starts to be taken up and an inversion position at which the traverse direction is inverted, based on the detection results provided by the detection means.

In an embodiment of the present invention, the detection means may include flange position measurement means for measuring a position of at least one of the flanges of the bobbin; and inter-flange distance measurement means for measuring the inter-flange distance between the flanges at a plurality of positions in a circumferential direction.

In an embodiment of the present invention, the line body take-up device may further comprise bobbin determination means for determining whether the bobbin is usable or not depending on whether the take-up pitch setting means can set the take-up pitch to 1.01 to 1.25 times the width of the line body based on the traverse position set by the traverse position setting means and a size and a shape of the line body.

The present invention is also directed to a line body take-up method for taking up a line body around a bobbin having a flange at each of two ends thereof in an axial direction, by taking up the line body around an outer circumferential surface of a winding body of the bobbin at a predetermined take-up pitch with aligned winding while moving the bobbin to traverse, so that a winding position of the line body is sequentially changed in the axial direction, to form a wound line body layer; inverting the direction of traverse when the line body is wound up to an inner edge of the flange of the bobbin; and winding the line body around an outer circumferential surface of the previous wound line body layer, formed by winding the line body so far, in an aligned manner at the take-up pitch to form a subsequent wound line body layer, by use of a line body turn part by which the previous wound line body layer is transferred to the subsequent wound line body layer. The line body take-up method uses a line body take-up device. The line body take-up device comprises a first line body winding guide mechanism including a pair of roller units respectively corresponding to two transverse directions and each including an outer circumferential press roller part for contacting and pressurizing an outer circumferential surface of a line body winding part, which is being wound in a layer in an aligned manner, and a flange roller part for contacting a side surface of the line body winding part on a forward side in the traverse direction, the outer circumferential press roller part and the flange roller part being integrated together, wherein the first line body winding guide mechanism selects one of the pair of roller units in accordance with the traverse direction to be used and guides the line body to the outer circumferential surface of the winding body. The line body take-up device also comprises a second line body winding guide mechanism including a first press block by which when the line body winding part approaches the vicinity of the flange of the bobbin, a main body side surface of the first press block contacts an inner side surface of the flange and a main body tip surface of the first press block contacts and pressurizes the outer circumferential surface of the wound line body layer; when the subsequent wound line body layer starts to be wound by use of the line body turn part, the main body tip surface of the first press block contacts and pressurizes an outer circumferential surface of the line body turn part in the subsequent wound line body layer; and when the traverse direction is inverted, the main body tip surface of the first press block contacts and pressurizes the outer circumferential surface of the previous wound line body layer so that the main body side surface of the first press block contacts a side surface of the line body turn part in the subsequent wound line body layer on the forward side in the inverted traverse direction; a second press block, incorporated in a main body of the first press block, with which until the line body winding part approaches the vicinity of the flange of the bobbin, a tip surface of the second press block is generally flush with the main body tip surface of the first press block; when the subsequent wound line body layer starts to be wound at the inner edge of the flange, the second press block protrudes from the main body tip surface of the first press block to press the outer circumferential surface of the previous wound line body layer by means of the tip surface of the second press block, and also a side surface of the second press block contacts a side surface of the line body winding part in the subsequent wound line body layer on a backward side in the traverse direction; and traverse inversion signal transmission means for, when the first press block is put on the subsequent wound line body layer at the inner edge of the flange, transmitting a traverse inversion signal. The line body take-up method sets the take-up pitch to 1.01 to 1.25 times a width of the line body.

In one embodiment of the present invention, the flange roller part may have a structure of pressing the side surface of the line body winding part on the forward side in the traverse direction in an opposite direction to the traverse direction in the vicinity of the flange so that, when the line body winding part is inadvertently shifted in the traverse direction, the flange roller part contacts the side surface of the line body winding part on the forward side in the traverse direction and/or a space for winding the line body turn part is provided with certainty at the inner edge of the flange.

In one embodiment of the present invention, a position of each of the two flanges of the bobbin and a distance between the flanges may be detected, and a traverse position formed of a start position at which the line body starts to be taken up and an inversion position at which the traverse direction is inverted may be set based on results of the detection; and for taking up the line body around the outer circumferential surface of the winding body, the take-up pitch may be set after a space for winding the line body turn part is provided with certainty.

In one embodiment of the present invention, it may be determined whether the bobbin is usable or not depending on whether the take-up pitch can be set to 1.01 to 1.25 times the width of the line body based on the traverse position and a size and a shape of the line body.

The line body may be formed of, for example, a flat electric line including a conductor having a rectangular cross-section and an insulating member of enamel or the like for covering the conductor, or of a circular electric line having a circular cross-section.

The means for detecting the positions of the flanges of the bobbin or the distance between the flanges may be a technique of detecting the positions of the two flanges by means of, for example, two laser-operated position detectors and also calculating the inter-flange distance between the two flanges based on the positions of the flanges; a technique of detecting the positions of the two flanges by means of one laser-operated position detector; a technique of detecting the position of one of the flanges by means of, for example, one of the two laser-operated position detectors and detecting a distance from one of the flanges to the other flange by means of the other position detector; or the like.

According to one or more embodiments of the present invention, the line body can be wound in a completely aligned manner even in the vicinity of the inner edge of the bobbin. Even when the line body has a small cross-section and needs to be wound with a large number of winds in one layer around the bobbin, the line body can be wound in a completely aligned manner in all the layers wound around the bobbin, by appropriately selecting the bobbin, correcting the traverse position, appropriately selecting the take-up pitch for certainly providing a gap in which one wind of the line body can be put at the inner edge of the flange, and appropriately locating the flange roller part.

DESCRIPTION OF EMBODIMENTS

Embodiments of the present invention will be described with reference to the drawings.

Figure 1:
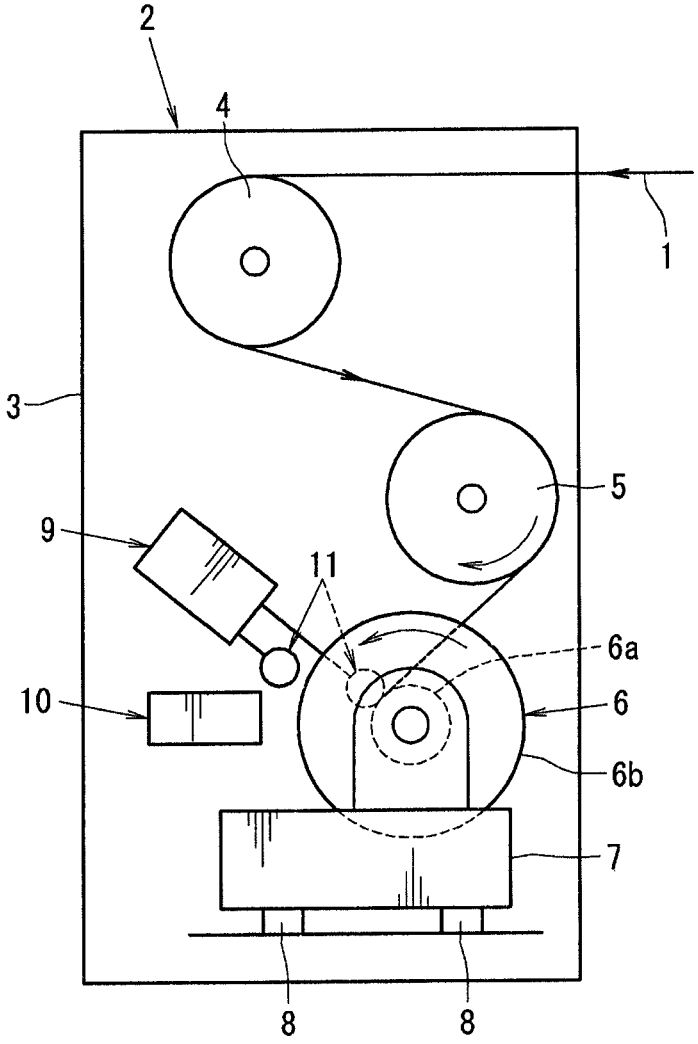
FIG. 1 is a front view showing a schematic structure of a line body take-up device according to one or more embodiments of the present invention.
Figure 2:
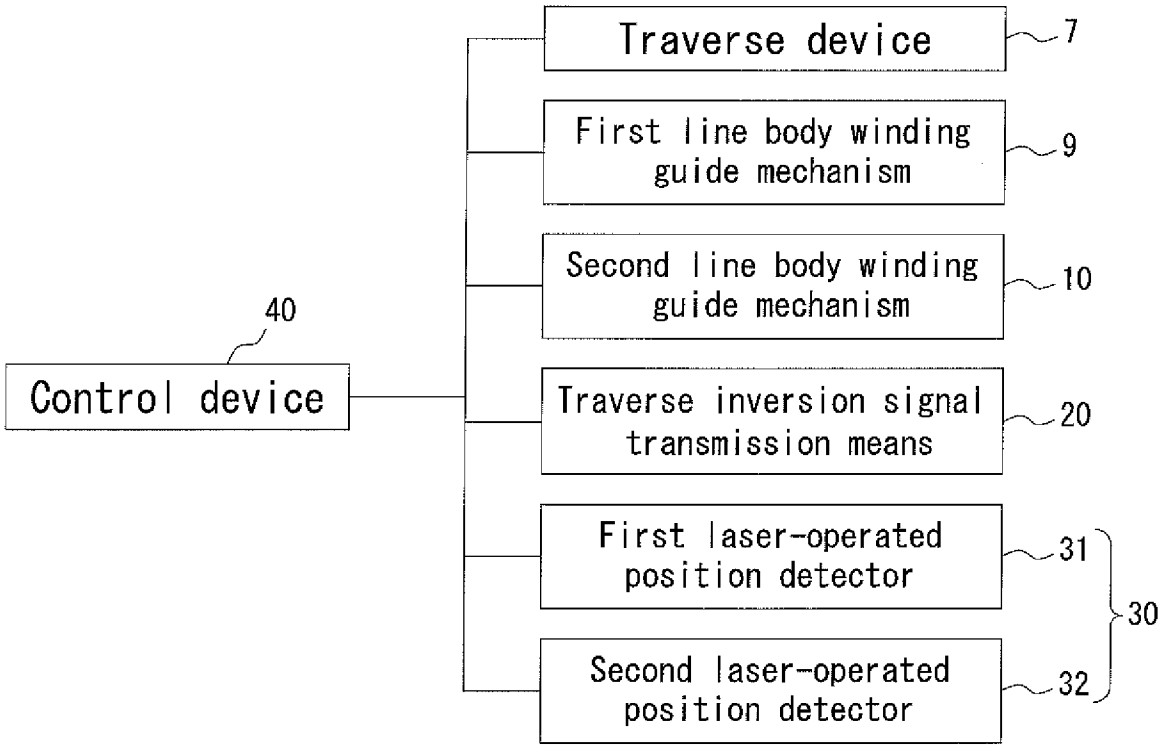
FIG. 2 is a block diagram showing the schematic structure of the line body take-up device.
Figure 3:
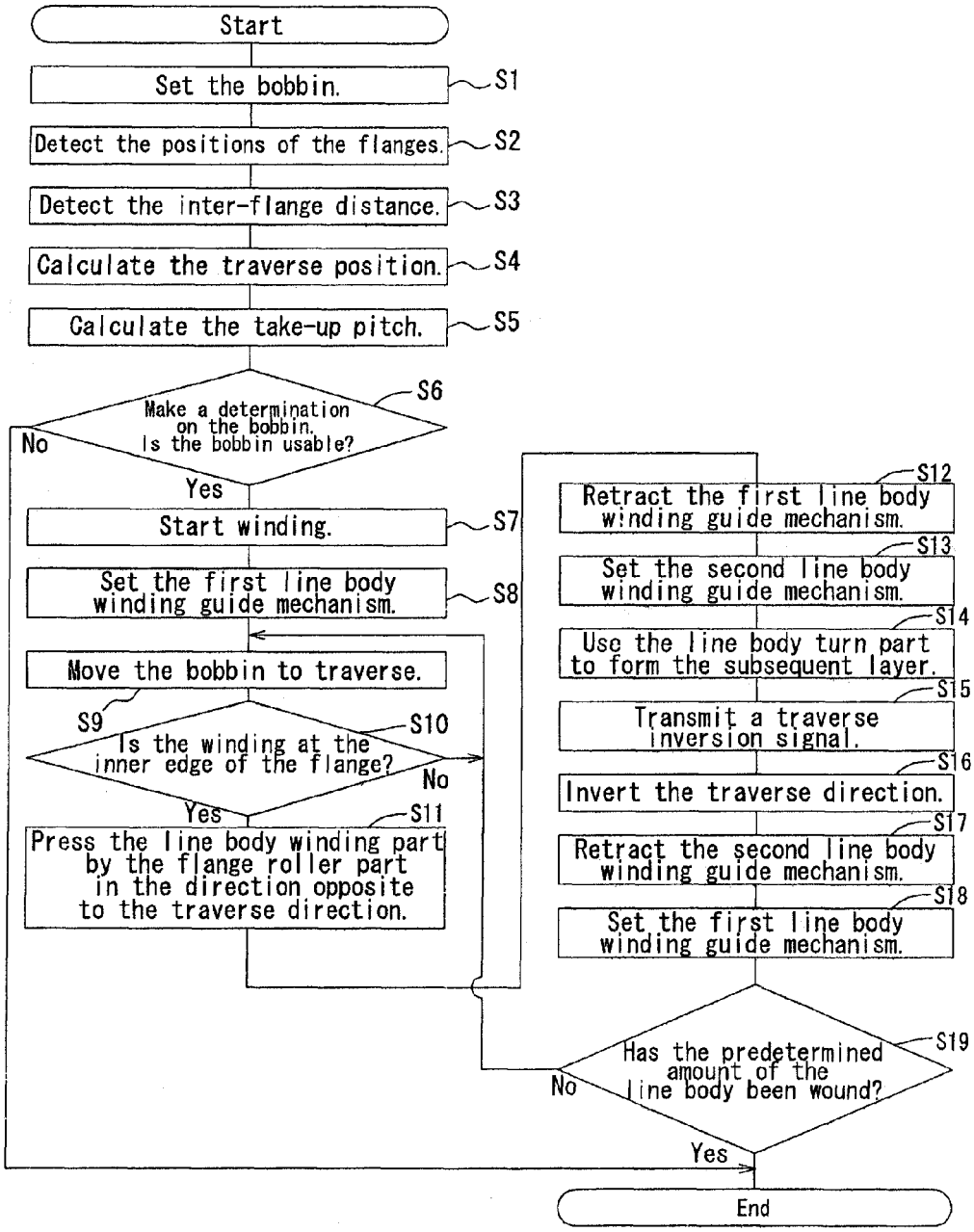
FIG. 3 is a flowchart showing a line body winding method using the line body take-up device.
Figure 4:
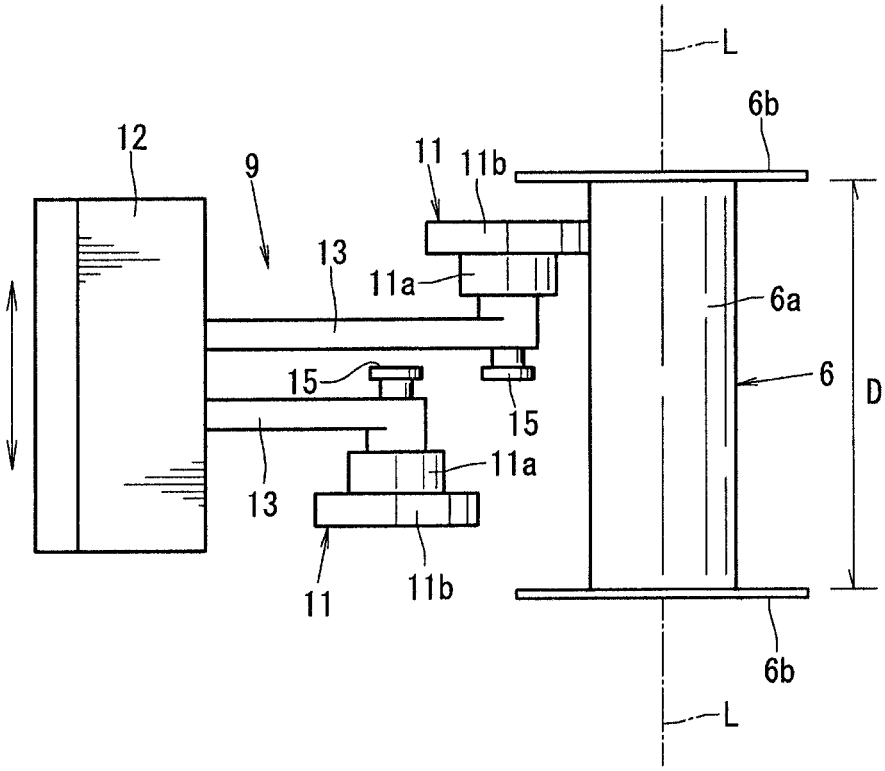
FIG. 4 is a plan view showing a schematic structure of a first line body winding guide mechanism.
Figure 5:
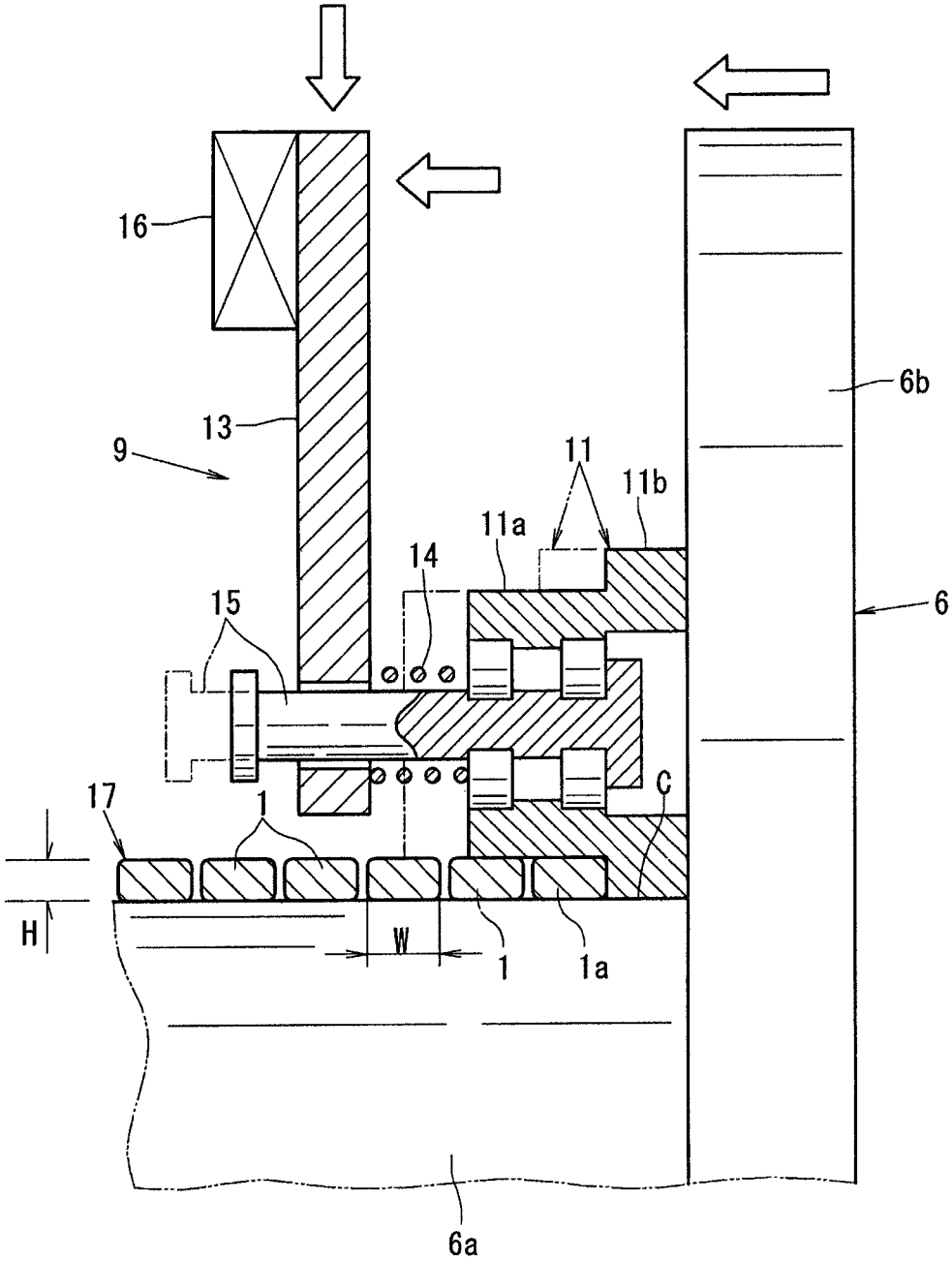
FIG. 5 is an enlarged cross-sectional view of an important part showing a structure and an operation of a press roller unit.
Figure 6:
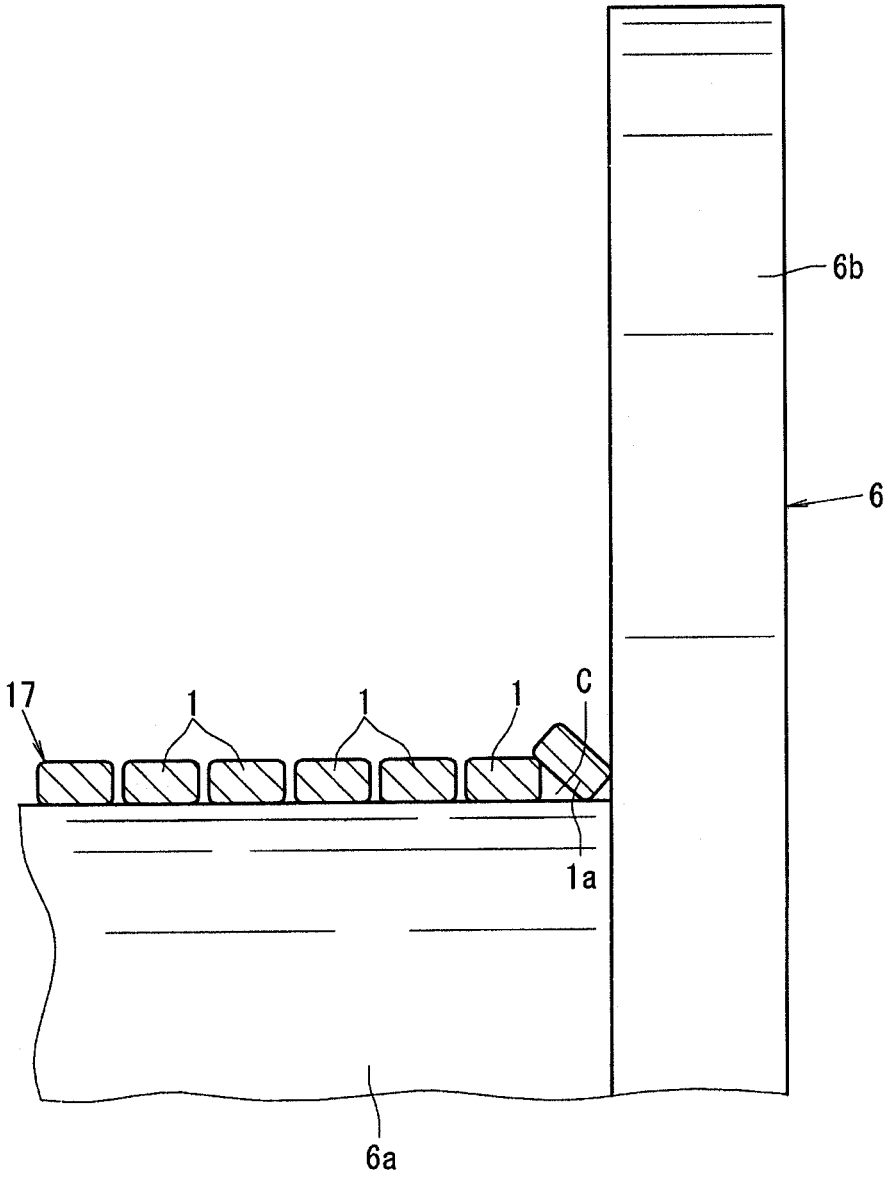
FIG. 6 shows a state where a line body falls at an inner edge of a flange of a bobbin.
Figure 7A:
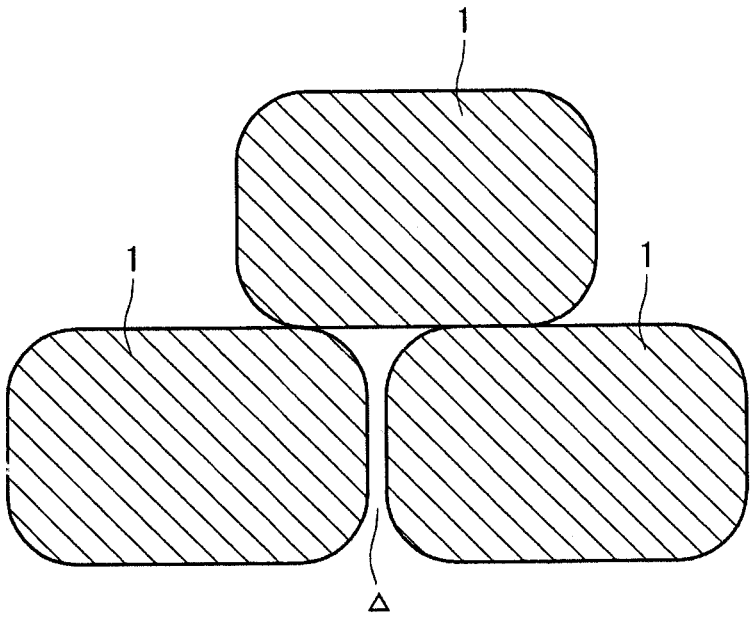
FIG. 7 shows a state where an upper layer of the line body does not fall (a), and a state where the upper layer of the line body falls (b).
Figure 7B:
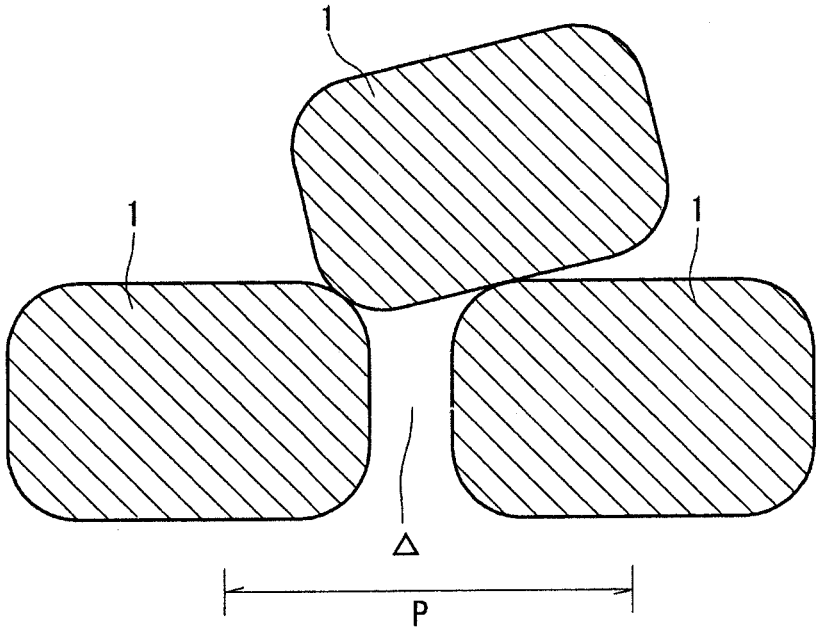
Figure 8:
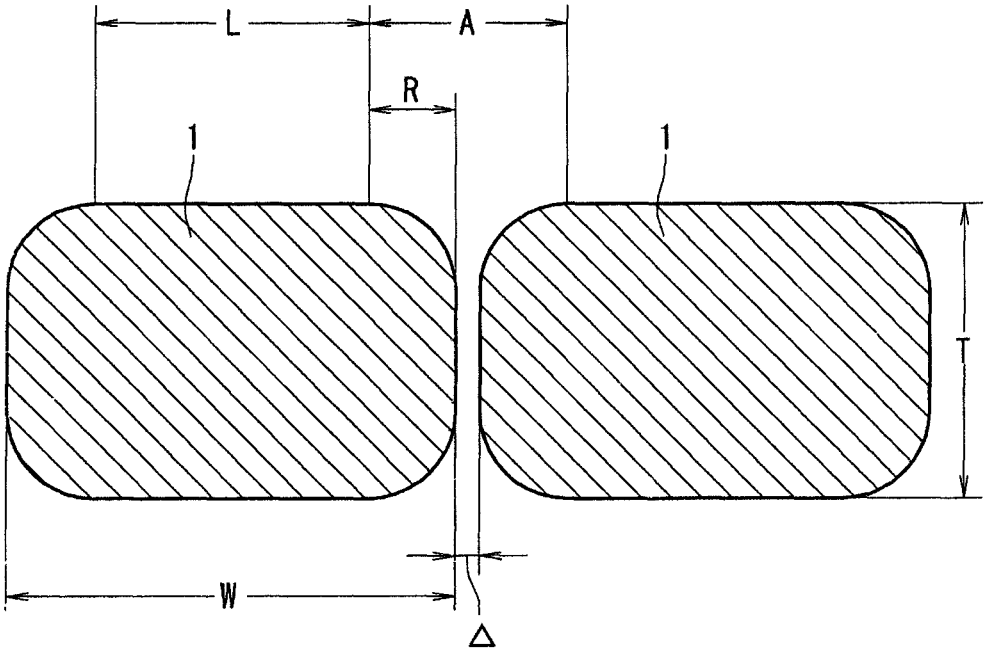
FIG. 8 shows a take-up pitch of the line body.
Figure 9:
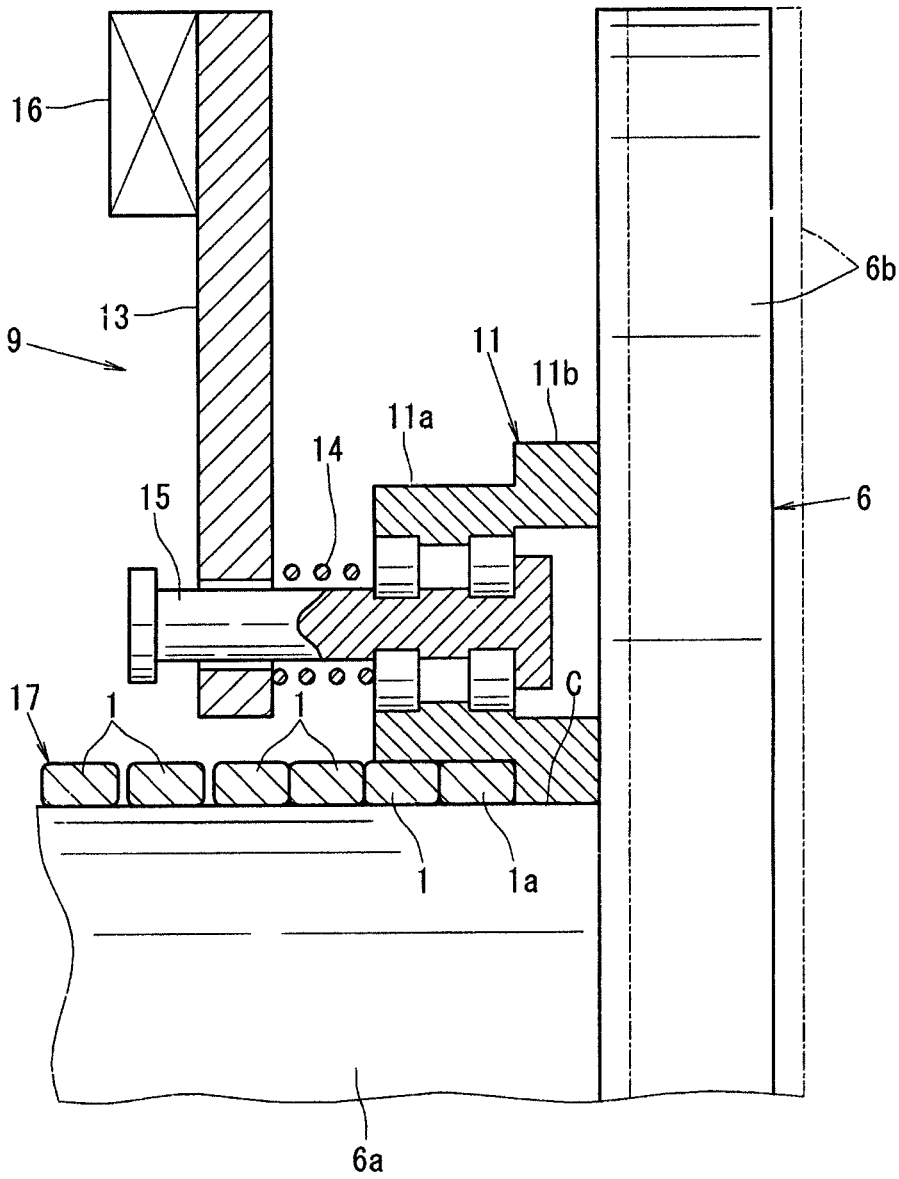
FIG. 9 shows a state where a clearance in which one wind of the line body can be put is provided with certainty at an inner edge of the flange of the bobbin.
Figure 10:
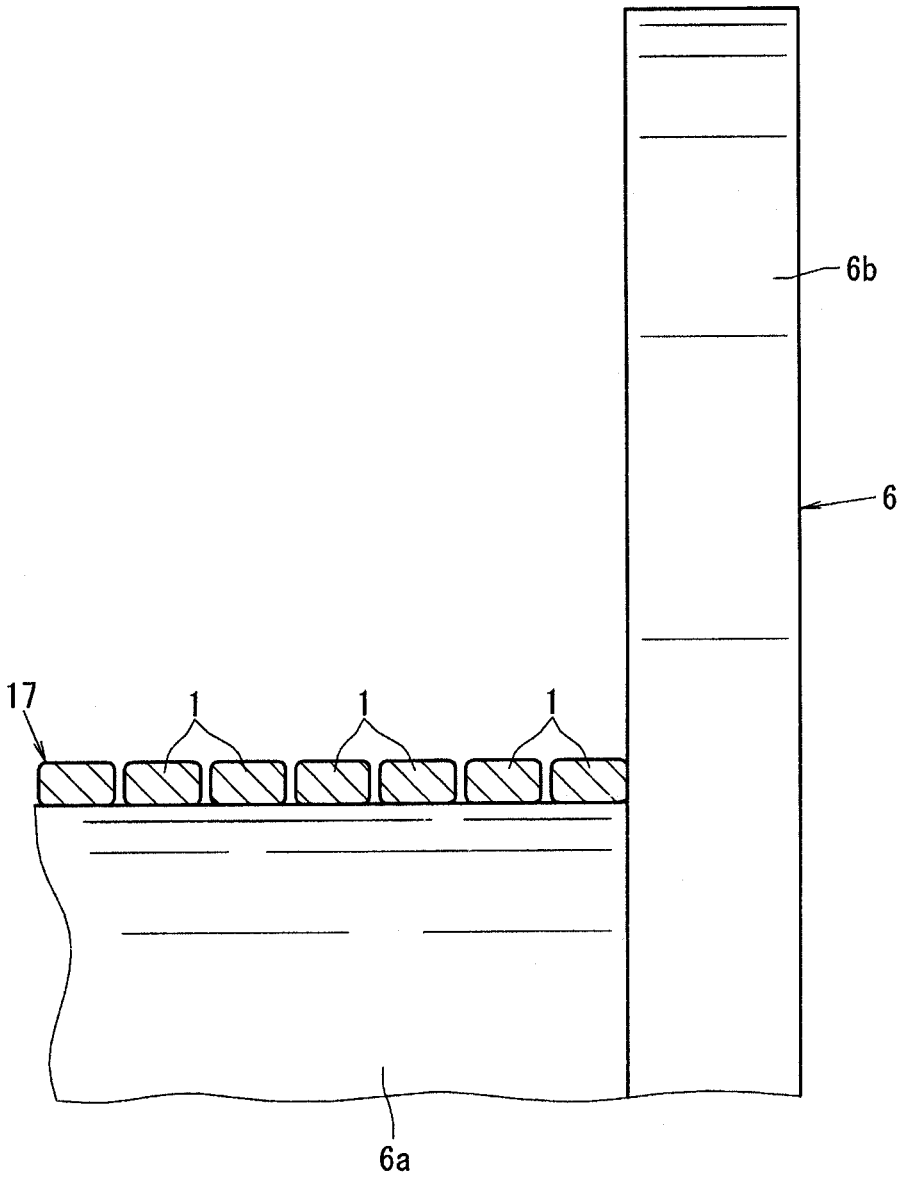
FIG. 10 shows a state where one wind of the line body is put at the inner edge of the flange of the bobbin.

FIG. 1 is a front view showing a schematic structure of a line body take-up device 2, FIG. 2 is a block diagram showing the schematic structure of the line body take-up device 2, and FIG. 3 is a flowchart showing a line body winding method using the line body take-up device 2. FIG. 4 is a plan view showing a schematic structure of a first line body winding guide mechanism 9, and FIG. 5 is an enlarged view of an important part showing a structure and an operation state of a press roller unit 11. FIG. 6 shows a state where a line body 1 falls at an inner edge of a flange 6*b* of a bobbin 6. FIG. 7 shows a state where an upper layer of the line body 1 in does not fall (a) and a state where the upper layer of the line body 1 falls (b). FIG. 8 shows a take-up pitch of the line body 1. FIG. 9 shows a state where a clearance C in which one wind of the line body 1 can be put is provided with certainty at the inner edge of the flange 6*b* of the bobbin 6, and FIG. 10 shows a state where one wind of the line body 1 is put at the inner edge of the flange 6*b* of the bobbin 6.

The line body take-up device 2 takes up the line body 1 around an outer circumferential surface of a winding body 6*a* of the bobbin 6 with aligned winding, while causing the bobbin 6 to traverse in an axial direction of the winding body 6*a* by means of a traverse device 7 so that the winding position of the line body 1 is sequentially changed in the axial direction.

The line body take-up device 2 includes the traverse device 7, a first line body winding guide mechanism 9, a second line body winding guide mechanism 10, a laser-operated position detector 30, and a control device 40 (see FIG. 2). The traverse device 7, the first line body winding guide mechanism 9, the second line body winding guide mechanism 10, traverse inversion signal transmission means 20 of the second line body winding guide mechanism 10, and a first laser-operated position detector 31 and a second laser-operated position detector 32 included in the laser-operated position detector 30 are connected to the control device 40.

The line body 1 to be wound using the line body take-up device 2 is a flat electric line including a conductor having a cross-sectional shape as shown in FIG. 8 and an insulating member of enamel or the like for covering the conductor. For example, the line body 1 has a cross-sectional shape with a thickness T of 1 mm, a width W of 1.56 mm and a corner chamfering R of 0.3 mm.

As shown in FIG. 1, in the line body take-up device 2, the line body 1 is wound around the outer circumferential surface of the winding body 6*a* of the bobbin 6 in an aligned manner after being transferred by a guide sieve 4 and a guide sieve 5 incorporated in a device frame 3.

The bobbin 6 around which the line body 1 is to be wound includes a flange 6*b*, for restricting the line body 1 to be on the outer circumferential surface of the winding body 6*a*, at each of two ends thereof in the axial direction L (FIG. 4) of the winding body 6*a* thereof. The bobbin 6 is driven, by the traverse device 7 incorporated in the device frame 3, to traverse in the axial direction L of the winding body 6*a* along rails 8.

The first line body winding guide mechanism 9 includes a pair of press roller units 11 located symmetrically with respect to a direction perpendicular to the axial direction L and roller loading means 12 for conveying a pressing force to the roller units 11 via arms 13. The first line body winding guide mechanism 9 is controlled by the control device 40 to select one of the pair of press roller units 11 for each traverse direction, and also loads the press roller unit 11 by means of the roller loading means 12 via the corresponding arm 13, thus to guide a line body winding part 1*a* of the line body 1 at a predetermined pitch while the line body winding part 1*a* is being wound around the outer circumferential surface of the winding body 6*a* of the bobbin 6.

In detail, the press roller units 11 each include an outer circumferential press roller part 11*a* and a flange roller part 11*b* which are integrated together. Each press roller unit 11 has a protruding shape lying in the axial direction L, which is the traverse direction. Namely, the axial direction of the protruding shape is parallel to the axial direction L.

The outer circumferential press roller part 11*a*, which is a smaller diameter part of the lying protruding shape, has a lying cylindrical shape having a height larger than the width W of the line body 1 to be wound around the bobbin 6. The flange roller part lib, which is a larger diameter part of the lying protruding shape, has a lying cylindrical shape having a height substantially equal to the width W of the line body 1 and a diameter which is larger than that of the outer circumferential press roller part 11*a* by a size substantially equal to the height H of the line body 1.

Each press roller unit 11 including the outer circumferential press roller part 11*a* and the flange roller part 11*b* which are integrated together as described above is mounted on the corresponding arm 13, for conveying the pressing force from the roller loading means 12, via a shaft 15. The shaft 15 is attached so as to run throughout the arm 13 in a direction perpendicular to the arm 13, and is slidable. A spring 14 is mounted on an outer circumferential surface of the shaft 15. Owing to the spring 14, the press roller unit 11 mounted on the arm 13 via the shaft 15 is loaded in a direction away from the arm 13. Accordingly, by a loading force provided by extension or contraction of the spring 14, a stress generated when the press roller unit 11 contacts the flange 6*b* of the bobbin 6 can be absorbed.

On a side surface of the arm 13, a stopper 16 (FIG. 5) for contacting a member (not shown) and stopping the arm 13 from moving beyond a predetermined range in the axial direction L is supported.

Owing to such a structure of the first line body winding guide mechanism 9, the outer circumferential press roller part 11*a* contacts at least an outer peripheral surface, namely, an upper part, of the line body winding part 1*a* of the layer of the line body which is being taken up at a predetermined pitch with aligned winding, and pressurizes such a part in a diametrically internal direction. The flange roller part 11*b* can guide a side surface of the line body winding part 1*a* on a forward side in the traverse direction.

In more detail, by the control of the control device 40 and the pressing force of the roller loading means 12, the flange roller part 11*b* guides the line body winding part 1*a*, except for at the inner edge of the flange 6*b*, to be wound at a take-up pitch while restricting the shift, in the axial direction L, of the side surface of the line body winding part 1*a* on the forward side in the traverse direction. Thus, the flange roller part 11*b* contacts the side surface of the line body winding part 1*a* on the forward side in the traverse direction and pressurizes the side surface in a direction opposite to the traverse direction. Due to this, the line body 1 can be wound around the winding body 6*a* accurately at the predetermined take-up pitch without inadvertently making a gap Δ between adjacent winds of the line body 1.

The first line body winding guide mechanism 9 and the second line body winding guide mechanism 10 described later are located to face the winding body 6*a* of the bobbin 6, with a slight positional diversion in a circumferential direction of the winding body 6*a* so that the mechanisms 9 and 10 do not interfere with each other.

Figure 11:
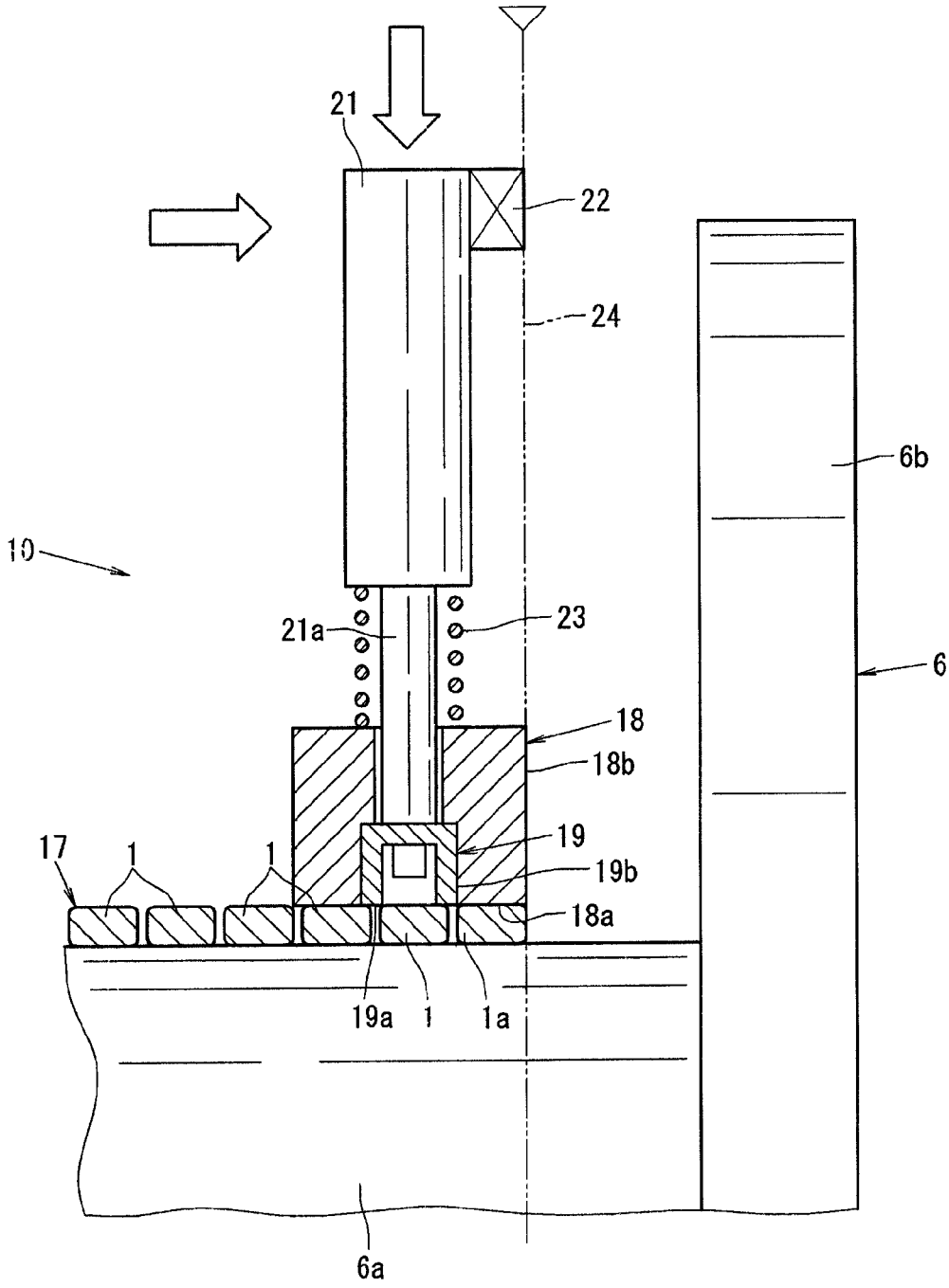
FIG. 11 is an enlarged cross-sectional view of an important part showing a structure and an operation of a second line body winding guide mechanism.
Figure 12:
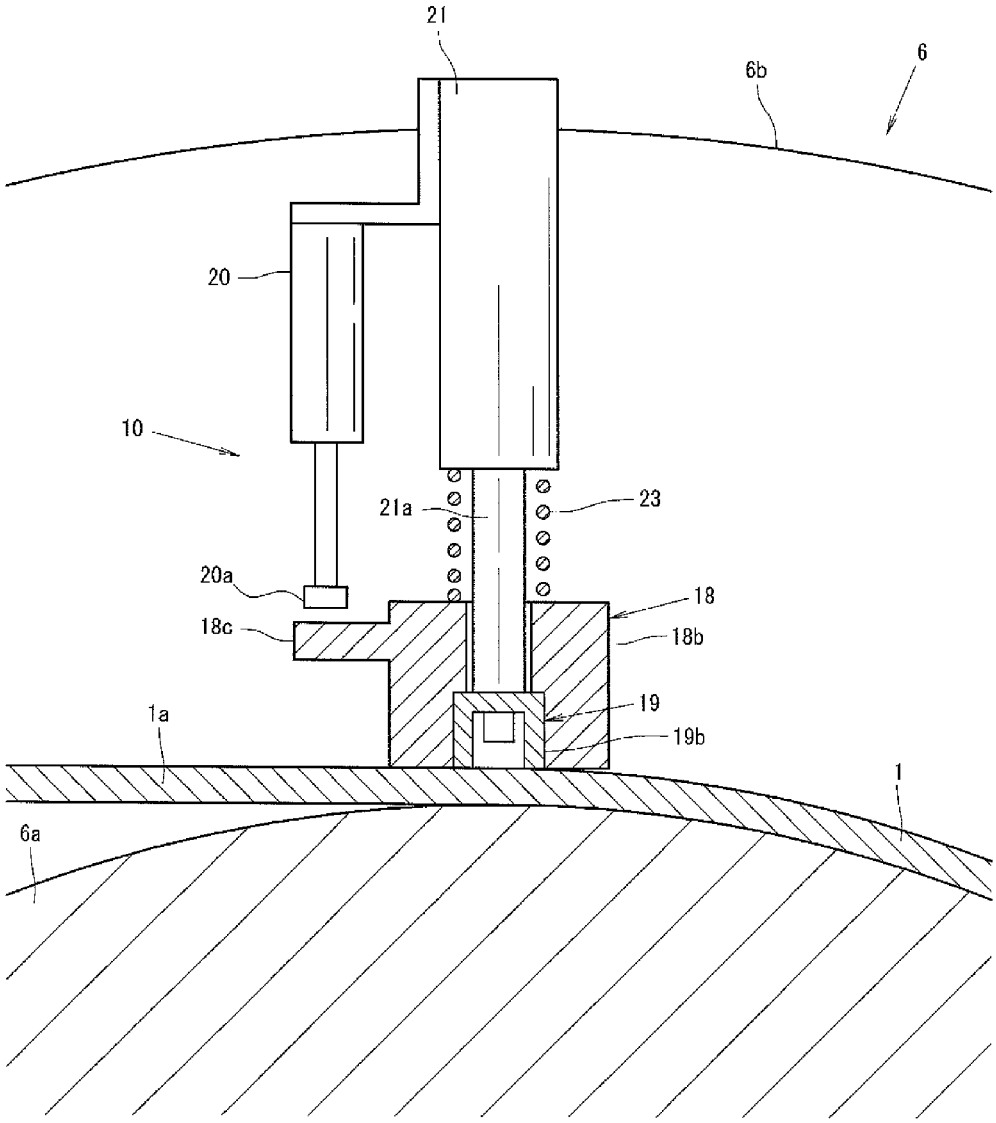
FIG. 12 is an enlarged cross-sectional view of an important part, taken in a transverse direction, showing the structure and the operation of the second line body winding guide mechanism.
Figure 13:
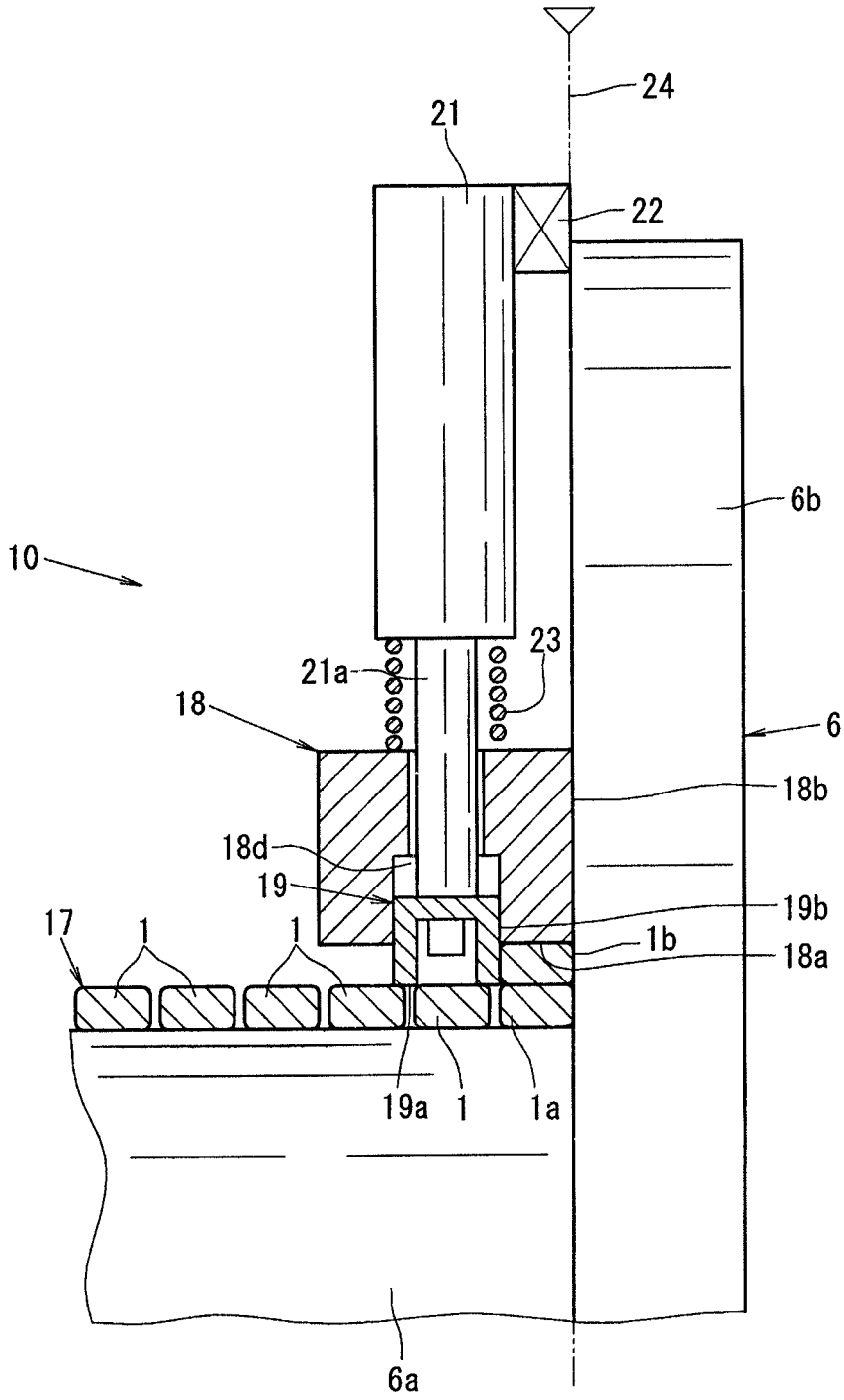
FIG. 13 is an enlarged cross-sectional view of an important part showing a state where a second press block is in contact with the second layer of the line body.
Figure 14:
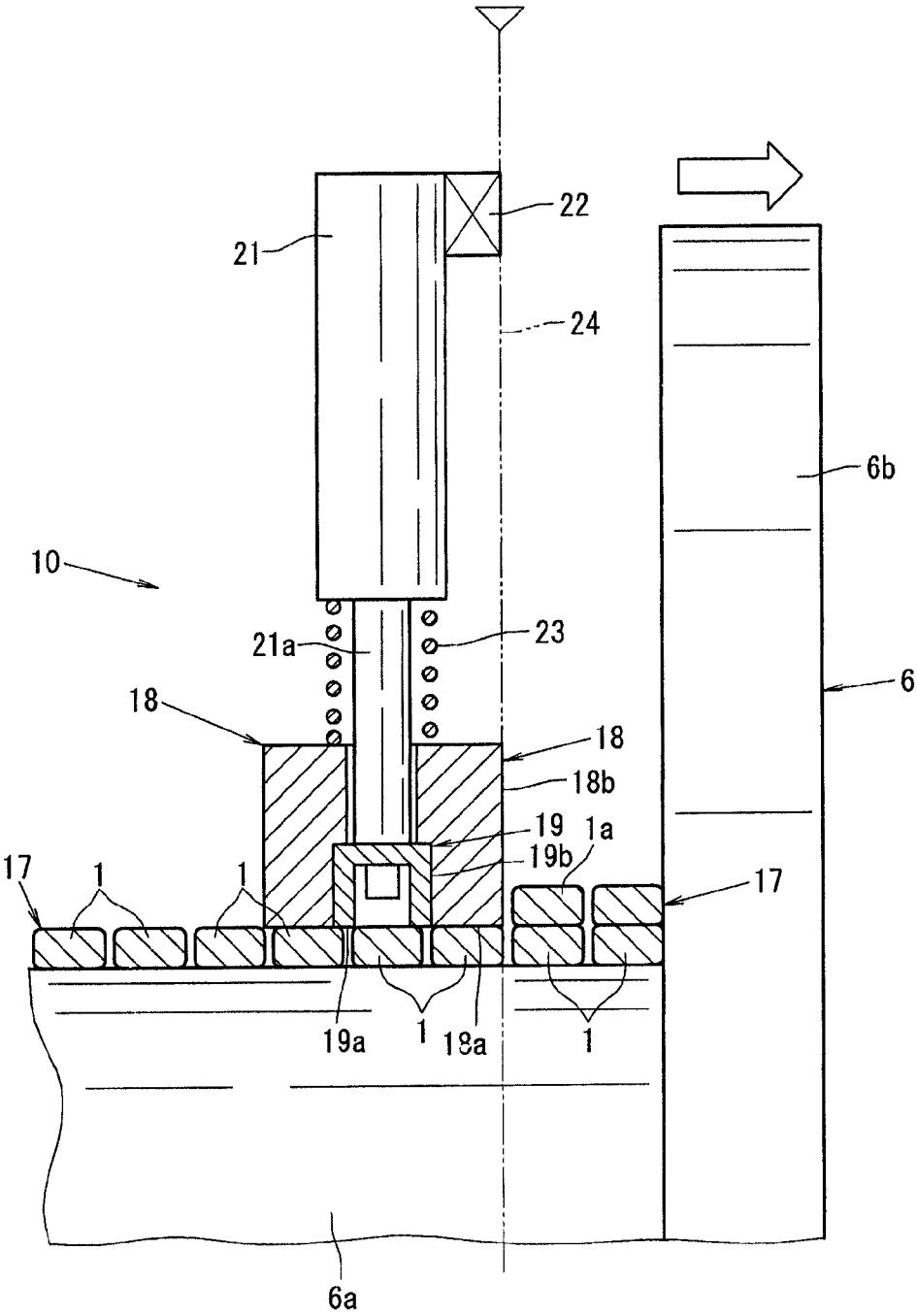
FIG. 14 is an enlarged cross-sectional view of an important part showing a state where a first press block is pressed on the first layer of the line body and is in contact with the second layer of the line body.

Now, with reference to FIG. 11 through FIG. 14, the second line body winding guide mechanism 10 will be described. FIG. 11 is an enlarged cross-sectional view of an important part showing a structure and an operation of the second line body winding guide mechanism 10, and FIG. 12 is an enlarged cross-sectional view of an important part, taken in a transverse direction (direction perpendicular to FIG. 11), showing the structure and the operation of the second line body winding guide mechanism 10. FIG. 13 is an enlarged cross-sectional view of an important part showing a state where a second press block 19 is in contact with the second layer of the line body 1, and FIG. 14 is an enlarged cross-sectional view of an important part showing a state where a first press block 18 is pressed on the first layer of the wound line body and is in contact with the second layer of the line body 1.

The second line body winding guide mechanism 10 includes the first press block 18, the second press block 19 and the traverse inversion signal transmission means 20.

In detail, the second line body winding guide mechanism includes a frame 21 moving in the diametrically internal direction toward the bobbin 6 by a cylinder (not shown), a smaller diameter axial part 21*a* protruding from a tip surface of the frame 21 toward the bobbin 6, the first press block 18 born by the smaller diameter axial part 21*a* to be slidable in the diametric direction, and the second press block 19 incorporated in an incorporating space 18*d* (FIG. 13) inside the first press block 18.

The first press block 18 has the incorporating space 18*d* therein for permitting the second press block 19 to be incorporated, and includes a main body side surface 18*b* contactable with the flange 6*b* of the bobbin 6 and a main body tip surface 18*a* for contacting and pressurizing an outer circumferential surface, namely, a top surface of a wound line body layer. 17 of the line body 1. The first press block 18 has a generally gate-shaped cross-section. The first press block 18 is loaded in the diametrically internal direction from the frame 21, namely, downward, by a loading force of a spring 23, which is loosely outserted around the smaller diameter axial part 21*a*. The first press block 18 includes an operator 18*c* for pressing upward a tip part 20*a* of a linear potentiometer acting as the traverse inversion signal transmission means 20 described later.

The second press block 19 incorporated in the incorporating space 18*d* of the first press block 18 has an inner size larger than the width of the line body 1 and a thickness equal to or greater than the gap Δ. The second press block 19 has a C-shaped cross-section with angular corners and a downward opening, and is connected and fixed to a tip of the smaller diameter axial part 21*a*. The second press block 19 is incorporated in the incorporating space 18*d* such that the main body tip surface 18*a* of the first press block 18 and a tip surface 19*a* of the second press block 19 are flush with each other.

As described above, the frame 21 moves in the diametrically internal direction toward the bobbin 6 by the cylinder (not shown). On an upper part of a side surface of the frame 21 on the flange 6*b* side, a stopper 22 is provided for contacting a member (not shown) at a position about 20 mm before the flange 6*b* of the bobbin 6 to restrict the movable range of the frame 21.

Rearward to the frame 21, the traverse inversion signal transmission means 20 formed of the linear potentiometer is provided for transmitting a traverse inversion signal when the first press block 18 is put on the upper wound line body layer 17 at the inner edge of the flange 6*b*.

The traverse inversion signal transmission means 20 acts as follows. When the first press block 18 is put on a wound line body layer 17, which is outer to the previous wound line body layer 17 mentioned above, the traverse inversion signal transmission means 20 is pressed by the operator 18*c* protruding from a side surface of the first press block 18 and thus transmits a traverse inversion signal. The traverse inversion signal transmitted from the traverse inversion signal transmission means 20 is given to the traverse device 7 for causing the bobbin 6 to traverse via the control device 40.

A reference position 24 (represented in the figure with the one-dot chain line) of the second line body winding guide mechanism 10 is set to a position at which the main body side surface 18*b* of the first press block 18 contacts an inner side surface of the flange 6*b* of the bobbin 6 in the state of the final traverse movement of the bobbin, namely, immediately before the traverse direction of the bobbin 6 is inverted.

Due to such a structure of the second line body winding guide mechanism 10, when the line body winding part 1*a* approaches the inner edge of the flange 6*b* of the bobbin 6, the main body tip surface 18*a* of the first press block 18 can contact and pressurize the outer circumferential surface of the wound line body layer 17 of the line body 1 in the diametrically internal direction.

When the line body 1 is wound at the inner edge of the flange 6*b*, the main body side surface 18*b* can contact the inner side surface of the flange 6*b*. At the inner edge of the flange 6*b*, the line body winding part 1*a* acts as a line body turn part 1*b*, by which the previous wound line body layer 17 obtained by winding the line body 1 so far is transferred to the subsequent wound line body layer 17, which is to be formed by winding the line body 1 around the outer circumferential surface of the previous wound line body layer 17. When the outer wound line body layer 17 starts to be wound by use of the line body turn part 1*b*, the first press block 18 moves in a diametrically external direction against the loading force of the spring 23, and the main body tip surface 18*a* is put on a top surface of the line body turn part 1*b* and can pressurize the line body turn part 1*b* (FIG. 13). When the traverse direction of the bobbin 6 is inverted, while the main body side surface 18*b* restricts a side surface of the line body turn part 1*b* on the forward side in the inverted traverse direction, the main body tip surface 18*a* can contact and pressurize the outer circumferential surface of the previous wound line body layer 17 (inner wound line body layer 17 in the diametric direction) (FIG. 14).

The second press block 19 is incorporated in the incorporating space 18*d* of the first press block 18 such that the tip surface 19*a* of the second press block 19 is flush with the main body tip surface 18*a* of the first press block 18. Therefore, the second press block 19, in addition to the main body tip surface 18*a*, can contact the outer circumferential surface of the wound line body layer 17 (FIG. 11).

When the line body turn part 1*b* starts to be wound at the inner edge of the flange 6*b* to form the subsequent wound line body layer 17 and the first press block 18 is put on the line body turn part 1*b*, the second press block 19 can protrude from the main body tip surface 18*a* of the first press block 18 in the diametrically internal direction (downward) to press the outer circumferential surface of the previous wound line body layer 17, which is diametrically inner to the subsequent wound line body layer 17, by means of the tip surface 19*a*. In this state, the second press block 19 can restrict a side surface of the line body turn part 1*b*, for forming the wound line body layer 17, on a backward side in the traverse direction by means of the side surface 19*b* (FIG. 13).

Due to the traverse inversion signal transmission means 20, it can be detected that the first press block 18 is put on the line body 1 forming the subsequent wound line body layer 17 and thus is elevated. Upon detecting that the first press block 18 is put on the line body 1, the traverse inversion signal transmission means 20 can transmit a traverse inversion signal to the traverse device 7, for causing the bobbin 6 to traverse, via the control device 40.

In the figure, the tip part 20*a* of the potentiometer and the operator 18*c* are away from each other, and the operator 18*c* presses the tip part 20*a* when the first press block 18 is elevated. Alternatively, the tip part 20*a* and the operator 18*c* may be in constant contact with each other.

The line body take-up device 2 includes the laser-operated position detector 30 for detecting the distance between the two flanges 6*b* of the bobbin 6 at a plurality of points. The laser-operated position detector 30 is located at a position which is not influenced by any of the first line body winding guide mechanism 9, the second line body winding guide mechanism 10 and the rotation of the bobbin 6.

The laser-operated position detector 30 includes the first laser-operated position detector 31 and the second laser-operated position detector 32 respectively for detecting the positions of the flanges 6*b*, which are respectively provided at both of the two ends of the winding body 6*a* in the axial direction L.

The laser-operated position detector 30 including the first laser-operated position detector 31 and the second laser-operated position detector 32 detects the positions of the flanges 6*b* at a plurality of points in the circumferential direction, and transmits the detection results to the control device 40.

Upon receiving the detection results from the laser-operated position detector 30, the control device 40 calculates an inter-flange distance D (FIG. 4) between the two flanges 6 at a plurality of points in the circumferential direction and also calculates an average inter-flange distance D obtained from the inter-flange distances D at the plurality of points in the circumferential direction.

As described above, the line body take-up device 2 includes the laser-operated position detector 30 which includes the first laser-operated position detector 31 and the second laser-operated position detector 32, and thus detects the positions of the flanges 6*b*. Therefore, the control device 40 can calculate the inter-flange distance D based on the detection results transmitted from the laser-operated position detector 30. The positions of the two flanges 6*b* are detected by the first laser-operated position detector 31 and the second laser-operated position detector 32. Therefore, the positions of the flanges 6*b* and the inter-flange distance D can be calculated by a simple structure. Accordingly, the bobbin 6 having the flanges 6*b* largely curved partially can be detected.

The laser-operated position detector 30 including the first laser-operated position detector 31 and the second laser-operated position detector 32 may have a structure by which one of the laser-operated position detectors detects the position of one of the flanges 6*b* and the other laser-operated position detector detects the inter-flange distance D. Alternatively, one laser-operated position detector may detect the positions of the two flanges 6*b*.

Now, take-up processing performed by the line body take-up method using the line body take-up device 2 will be described mainly with reference to FIG. 3, which is a flowchart of the method using the line body take-up device 2.

The take-up processing performed by the line body take-up method using the line body take-up device 2 is as follows. First, as shown in FIG. 1 and FIG. 4, the line body 1 is wound around the outer circumferential surface of the winding body 6*a* of the bobbin 6 in an aligned manner after being transferred by the guide sieves 4 and 5 incorporated in the device frame 3. While the line body 1 is wound, the bobbin 6 is caused to traverse by the traverse device 7 in the axial direction so that the winding position of the line body 1 is sequentially changed in the axial direction of the winding body 6*a*.

For starting the winding processing of the line body 1 by the line body take-up method in this embodiment using the line body take-up device 2, the line body 1 to be taken up is set and also the bobbin 6 around which the line body 1 is to be wound is set in the device frame 3 (step S1). The line body take-up device 2 having the bobbin 6 set at a predetermined position detects the positions of the flanges 6*b* of the bobbin 6 by means of the laser-operated position detector 30 (step S2), and calculates the inter-flange distance D, which is the distance between the flanges 6*b*, by means of the control device 40 (step S3).

Based on the flange positions detected in step S2 and the inter-flange distance D calculated in step S3, the control device 40 calculates a traverse position which is formed of a start position on the winding body 6*a* at which the line body 1 starts to be wound and a traverse inversion position at which the traverse direction of the bobbin 6 is inverted (step S4).

Based on the traverse position and the shape and width W of the line body 1, the control device 40 calculates a take-up pitch P by which the traverse device 7 moves the bobbin 6 to traverse pitch by pitch (step S5). The take-up pitch P is a sum of the width W and the gap Δ, and the control device 40 sets the take-up pitch P to be 1.01 to 1.25 times the width W of the line body 1 (see FIG. 8).

Based on the traverse position, the shape and width W of the line body 1, and the take-up pitch P set to be 1.01 to 1.25 times the width W of the line body 1, the control device 40 calculates the number of the wound line body layers 17 to be formed by winding the line body 1 around the bobbin 6 and the amount of the line body 1 which can be wound around the bobbin 6. When a desired amount of the line body 1 can be wound around the bobbin 6, the control device 40 determines that the bobbin is usable; whereas when a desired amount of the line body 1 cannot be wound around the bobbin 6, the control device 40 determines that the bobbin is inferior (step S6).

When the bobbin is determined to be inferior (step S6: No), the winding processing of the line body 1 performed using such a bobbin 6 is terminated. In this case, the processing can be re-started after the bobbin 6 set in the device frame 3 is replaced with another bobbin.

When it is determined that a desired amount of the line body 1 can be wound around the bobbin 6 and so the bobbin 6 is usable (step S6: Yes), the line body take-up device 2 starts winding the line body 1 from the start position while rotating the bobbin 6 (step S7). At this point, as shown in FIG. 5, the line body take-up device 2 moves one of the pair of press roller units 11 of the first line body winding guide mechanism 9 forward in the diametrically internal direction of the bobbin 6 to set the press roller unit 11 at a predetermined position (step S8; see FIG. 1), and takes up the line body 1 while restricting the line body 1 so that the winding position on the winding body 6*a* of the line body winding part 1*a* is not inadvertently shifted until the line body winding part 1*a* arrives at the inner edge of the flange 6*b*, i.e., until the traverse direction is inverted.

In this state, the outer circumferential press roller part 11*a* of the press roller unit 11 contacts and pressurizes an outer circumferential surface of the line body 1 wound around the winding body 6*a* in the diametrically internal direction so that the take-up pitch P of the wound line body 1 is not inadvertently shifted.

While the line body 1 is being taken up, the traverse device 7 moves the bobbin 6 to traverse at the take-up pitch P so that the winding position of the line body winding part 1*a* is changed in the axial direction of the winding body 6*a* until the inner edge of the flange 6*b* (step S9). Thus, the line body 1 is wound around the outer circumferential surface of the winding body 6*a* in an aligned manner.

The traverse device 7 continues to move the bobbin 6 to traverse until the line body winding part 1*a* arrives at the inner edge of the flange 6*b* (step S10: No). When the line body winding part 1*a* arrives at the inner edge of the flange 6*b* (step S10: Yes), the side surface of the flange roller part lib on the flange 6*b* side contacts the inner side surface of the flange 6*b* and thus presses the side surface of the line body winding part 1*a* on the forward side in the traverse direction, in the opposite direction to the traverse direction (step S11). The flange roller part 11*b* has a thickness which is approximately the same as that of the width W of the line body 1, and so the clearance C for winding the line body turn part 1*b*, by which the previous layer is transferred to the subsequent layer, can be provided with certainty at the inner edge of the flange 6*b* (see FIG. 9).

In this manner, the clearance C in which the line body turn part 1*b* is wound is provided with certainty at the inner edge of the flange 6*b* by the flange roller part 11*b*. When the line body turn part 1*b* is wound in the clearance C, the first line body winding guide mechanism 9 is retracted in the diametrically external direction of the bobbin 6 (step S12). As shown in FIG. 11, the second line body winding guide mechanism 10, which has been waiting at a position away from the winding body 6*a* in the diametrically external direction, moves forward in the diametrically internal direction of the bobbin 6 and presses the outer circumferential surface of the wound line body layer 17 by means of the tip surface 18*a* of the first press block 18 (step S13).

In this state, outer to the first wound line body layer 17 (hereinafter, referred to as the "previous wound line body layer 17") formed by winding the line body 1 around the outer circumferential surface of the winding body 6*a* at the take-up pitch P, the second wound line body layer 17 (hereinafter, referred to as the "subsequent wound line body layer 17") is to be formed by winding the line body 1. For this purpose, the line body turn part 1*b* is used to start forming the subsequent wound line body layer 17 (step S14). When this occurs, as shown in FIG. 13, the first press block 18 is put on the line body turn part 1*b* at the beginning of the second wound line body layer 17 against the loading force of the spring 23. The first press block 18 is elevated and retracted from the winding body 6*a*, whereas the second press block 19 remains at the same position to restrict the side surface of the line body turn part 1*b* on the backward side in the traverse direction.

When the first press block 18 is elevated away from the winding body 6*a*, the operator 18*c* protruding from a rear surface of the first press block 18 is also elevated and so presses the traverse inversion signal transmission means 20 formed of the linear potentiometer (FIG. 12).

The traverse inversion signal transmission means 20 pressed by the operator 18*c* as a result of the elevation of the first press block 18 transmits a traverse signal to the traverse device 7 via the control device 40 (step S15). Upon receiving the traverse signal from the traverse inversion signal transmission means 20, the traverse device 7 inverts the traverse direction (step S16).

When the traverse direction of the bobbin 6 is inverted and the bobbin 6 moves in the direction shown by the arrow in FIG. 14, the first press block 18 moves in the diametrically internal direction by the loading force of the spring 23 so that the tip surface 18*a* contacts the outer circumferential surface of the first or previous wound line body layer 17, and presses the outer circumferential surface of the first wound line body layer 17 by means of the tip surface 18*a*.

The side surface 18*b* of the first press block 18 contacts and presses the side surface of the line body turn part 1*b*, used to form the second or subsequent wound line body layer 17, on the forward side in the traverse direction.

In this state, the second line body winding guide mechanism 10 is retracted in the diametrically external direction of the bobbin 6 (step S17). Among the pair of roller units 11 of the first line body winding guide mechanism 9 which has been waiting at a position away from the winding body 6*a* in the diametrically external direction, the other roller unit 11 corresponding to the traverse direction is moved forward in the diametrically internal direction of the bobbin 6.

The outer circumferential press roller part 11*a* is put into contact with the outer circumferential surface of the subsequent wound line body layer 17, and the flange roller part 11*b* takes up the line body 1 while restricting the side surface of the line body winding part 1*a* on the forward side in the traverse direction so that the winding position thereof is not inadvertently shifted on the winding body 6*a* (step S18).

The operation of the first line body winding guide mechanism 9 and the second line body winding guide mechanism 10 of holding and restricting the line body 1 at the winding position and the operation of the traverse device 7 of moving the line body 1 to traverse at the take-up pitch P and inverting the traverse direction are repeated until a predetermined amount of the line body 1 is wound (step S19: No). When the predetermined amount of the line body 1 is fully wound (step S19: Yes), the take-up processing is terminated.

As described above, according to the structure in this embodiment, the line body winding part 1*a* in the subsequent wound line body layer 17 does not fall into a gap between adjacent winds of the previous wound line body layer 17, and thus the line body 1 can be wound in a completely aligned manner up to the inner edge of the flange 6*b* of the bobbin 6.

Even when the line body 1 has a small cross-section and needs to be wound with a large number of winds in one layer around the bobbin 6, the line body 1 can be wound in a completely aligned manner around the entire circumferential surface of the bobbin 6 and in all the layers, by appropriately selecting the bobbin 6, correcting the traverse position, appropriately selecting the take-up pitch for certainly providing the gap Δ in which one wind of the line body 1 can be put at the inner edge of the flange 6*b* of the bobbin 6, and appropriately locating the flange roller part 11*b*.

Before the line body 1 starts to be taken up, the inter-flange distance D between two flanges 6*b* of the bobbin 6 is detected by the laser-operated position detector 30 for each bobbin 6. Therefore, based on the detection results, the position at which the line body 1 starts to be taken up and the position at which the traverse direction is inverted can be defined.

The positions of the two flanges 6*b* of the bobbin 6 are detected by the laser-operated position detector 30. Therefore, the bobbin 6 having the flanges 6*b* largely curved partially can be detected.

Accordingly, based on the detection results regarding the flanges 6*b* of the bobbin 6 and the size and shape of the line body 1 to be taken up, a bobbin 6 with which the take-up pitch cannot be 1.01 to 1.25 times the width of the line body can be excluded as an inferior bobbin 6 which is clearly inappropriate to be used for taking up the line body 1.

When the clearance C in which one wind of the line body 1 can be put cannot be provided with certainty at the inner edge of the flange 6*b* of the bobbin 6, or when the subsequent wound line body layer of the line body 1 falls into the clearance C at the inner edge of the flange 6*b*, such a bobbin 6 can be excluded as an inferior bobbin.

Namely, based on the detection results regarding the flanges 6*b* of the bobbin 6 and the size and shape of the line body 1 to be taken up, the winding positions of the line body 1 from the start of take-up of the first wound line body layer until a predetermined number of layers of the line body is taken up are calculated. Thus, a bobbin 6 with which the take-up pitch cannot be 1.01 to 1.25 times the width of the line body can be determined as an inferior bobbin 6.

The flange 6*b* of the bobbin 6 may be curved toward the winding body. When the clearance C in which one wind of the line body 1 can be put cannot be provided with certainty at the inner edge of such a curved part of the flange 6 even by pushing the line body 1 by means of the pressing force of the flange roller part 11*b*, the bobbin 6 can be determined as being inferior. The flange 6*b* of the bobbin 6 may also be curved away from the winding body. When the next layer of the line body 1 falls into the clearance C made at the inner edge of such a curved part of the flange 6, the bobbin 6 can be determined as being inferior.

The elements of the present invention and the elements in the above-described embodiments correspond as follows.

The means for detecting the positions and the inter-flange distance, the flange position measurement means, and the inter-flange distance measurement means (first and second laser-operated position detectors) of the present invention correspond to the laser-operated position detector 30, the first laser-operated position detector 31 and the second laser-operated position detector 32 in this embodiment;

the inter-flange distance of the present invention corresponds to the inter-flange distance D in this embodiment;

the take-up pitch setting means of the present invention corresponds to the control device 40 performing step S5 in this embodiment;

the traverse position setting means of the present invention corresponds to the control device 40 performing step S4 in this embodiment; and the bobbin determination means of the present invention corresponds to the control device 40 performing step S6 in this embodiment.

The present invention is not limited to the above-described embodiments and can be applied for other uses based on the technological philosophy shown by the claims and carried out in various other embodiments.

In the above embodiments, a flat electric line is shown as the line body 1, but the present invention is not limited to this and the line body 1 may be a line having a circular cross-section.

Another example of the means for detecting the positions of the flanges and the inter-flange distance may use image processing.

INDUSTRIAL APPLICABILITY

One or more embodiments of the present invention are usable for a line body take-up device for winding a line body having a rectangular cross-section such as a flat electric line or the like around a bobbin in an aligned manner, and a line body take-up method used for such a device.

One or more embodiments of the present invention are also usable for a line body take-up device for winding a line body having a circular cross-section such as an electric line or the like around a bobbin in an aligned manner, and a line body take-up method used for such a device.

The invention claimed is:

1. A line body take-up device for taking up a line body around a bobbin having a flange at each of two ends thereof in an axial direction, comprising:

a first line body winding guide mechanism; and a second line body winding guide mechanism:

wherein the line body take-up device operates:

by taking up the line body around an outer circumferential surface of a winding body of the bobbin at a predetermined take-up pitch with aligned winding while moving the bobbin to traverse, so that a winding position of the line body is sequentially changed in the axial direction, to form a wound line body layer;

inverting the direction of traverse when the line body is wound up to an inner edge of the flange of the bobbin; and winding the line body around an outer circumferential surface of the previous wound line body layer, formed by winding the line body so far, in an aligned manner at the take-up pitch to form a subsequent wound line body layer, by use of a line body turn part by which the previous wound line body layer is transferred to the subsequent wound line body layer;

wherein the first line body winding guide mechanism comprises a pair of roller units respectively corresponding to two transverse directions, wherein each roller unit comprises:

an outer circumferential press roller part for contacting and pressurizing an outer circumferential surface of a line body winding part, which is being wound in a layer in an aligned manner, and a flange roller part for contacting a side surface of the line body winding part on a forward side in the traverse direction, wherein the outer circumferential press roller part and the flange roller part are integrated together, wherein the first line body winding guide mechanism selects one of the pair of roller units in accordance with the traverse direction to be used and guides the line body to the outer circumferential surface of the winding body;

wherein the second line body winding guide mechanism comprises:

a first press block by which:

when the line body winding part approaches the vicinity of the flange of the bobbin, a main body side surface of the first press block contacts an inner side surface of the flange and a main body tip surface of the first press block contacts and pressurizes the outer circumferential surface of the wound line body layer;

when the subsequent wound line body layer starts to be wound by use of the line body turn part, the main body tip surface of the first press block contacts and pressurizes an outer circumferential surface of the line body turn part in the subsequent wound line body layer; and when the traverse direction is inverted, the main body tip surface of the first press block contacts and pressurizes the outer circumferential surface of the previous wound line body layer so that the main body side surface of the first press block contacts a side surface of the line body turn part in the subsequent wound line body layer on the forward side in the inverted traverse direction;

a second press block, incorporated in a main body of the first press block, with which:

until the line body winding part approaches the vicinity of the flange of the bobbin, a tip surface of the second press block is generally flush with the main body tip surface of the first press block;

when the subsequent wound line body layer starts to be wound at the inner edge of the flange, the second press block protrudes from the main body tip surface of the first press block to press the outer circumferential surface of the previous wound line body layer by means of the tip surface of the second press block, and also a side surface of the second press block contacts a side surface of the line body winding part in the subsequent wound line body layer on a backward side in the traverse direction;

a traverse inversion signal transmission unit for, when the first press block is put on the subsequent wound line body layer at the inner edge of the flange, transmitting a traverse inversion signal; and a take-up pitch setting unit for setting the take-up pitch to 1.01 to 1.25 times a width of the line body, wherein a cross-section of the line body has a substantially rectangular shape whose corners are rounded.

2. A line body take-up device according to claim 1, wherein the flange roller part has a structure of pressing the side surface of the line body winding part on the forward side in the traverse direction in an opposite direction to the traverse direction in the vicinity of the flange so that, when the line body winding part is inadvertently shifted in the traverse direction, the flange roller part contacts the side surface of the line body winding part on the forward side in the traverse direction and/or a space for winding the line body turn part is provided with certainty at the inner edge of the flange.

3. A line body take-up device according to claim 2, wherein for taking up the line body around the outer circumferential surface of the winding body, the take-up pitch setting unit sets the take-up pitch at which the bobbin is moved to traverse, after a space for winding the line body turn part is provided with certainty.

4. A line body take-up device according to claim 1, wherein for taking up the line body around the outer circumferential surface of the winding body, the take-up pitch setting unit sets the take-up pitch at which the bobbin is moved to traverse, after a space for winding the line body turn part is provided with certainty.

5. A line body take-up device according to claim 4, further comprising:

a detection unit for detecting a position of each of the two flanges of the bobbin and a distance between the flanges; and a traverse position setting unit for setting a traverse position formed of a start position at which the line body starts to be taken up and an inversion position at which the traverse direction is inverted, based on the detection results provided by the detection unit.

6. A line body take-up device according to claim 5, wherein the detection unit includes:

a flange position measurement unit for measuring a position of at least one of the flanges of the bobbin; and an inter-flange distance measurement unit for measuring the inter-flange distance between the flanges at a plurality of positions in a circumferential direction.

7. A line body take-up device according to claim 6, further comprising bobbin determination unit for determining whether the bobbin is usable or not depending on whether the take-up pitch setting unit can set the take-up pitch to 1.01 to 1.25 times the width of the line body based on the traverse position set by the traverse position setting unit and a size and a shape of the line body.

8. A line body take-up device according to claim 5, further comprising a bobbin determination unit for determining whether the bobbin is usable or not depending on whether the take-up pitch setting unit can set the take-up pitch to 1.01 to 1.25 times the width of the line body based on the traverse position set by the traverse position setting unit and a size and a shape of the line body.

9. A line body take-up method for taking up a line body around a bobbin having a flange at each of two ends thereof in an axial direction, the method comprising:

taking up the line body around an outer circumferential surface of a winding body of the bobbin at a predetermined take-up pitch with aligned winding while moving the bobbin to traverse, so that a winding position of the line body is sequentially changed in the axial direction, to form a wound line body layer;

inverting the direction of traverse when the line body is wound up to an inner edge of the flange of the bobbin; and winding the line body around an outer circumferential surface of the previous wound line body layer, formed by winding the line body so far, in an aligned manner at the take-up pitch to form a subsequent wound line body layer, by use of a line body turn part by which the previous wound line body layer is transferred to the subsequent wound line body layer;

wherein the line body take-up method uses a line body take-up device comprising a first line body winding mechanism and a second line body winding mechanism, wherein the first line body winding guide mechanism comprises a pair of roller units respectively corresponding to two transverse directions, wherein each roller unit comprises:

an outer circumferential press roller part for contacting and pressurizing an outer circumferential surface of a line body winding part, which is being wound in a layer in an aligned manner, and a flange roller part for contacting a side surface of the line body winding part on a forward side in the traverse direction, wherein the outer circumferential press roller part and the flange roller part are integrated together, wherein the first line body winding guide mechanism selects one of the pair of roller units in accordance with the traverse direction to be used and guides the line body to the outer circumferential surface of the winding body; and wherein the second line body winding guide mechanism comprises:

a first press block by which:

when the line body winding part approaches the vicinity of the flange of the bobbin, a main body side surface of the first press block contacts an inner side surface of the flange and a main body tip surface of the first press block contacts and pressurizes the outer circumferential surface of the wound line body layer;

when the subsequent wound line body layer starts to be wound by use of the line body turn part, the main body tip surface of the first press block contacts and pressurizes an outer circumferential surface of the line body turn part in the subsequent wound line body layer; and when the traverse direction is inverted, the main body tip surface of the first press block contacts and pressurizes the outer circumferential surface of the previous wound line body layer so that the main body side surface of the first press block contacts a side surface of the line body turn part in the subsequent wound line body layer on the forward side in the inverted traverse direction;

a second press block, incorporated in a main body of the first press block, with which:

until the line body winding part approaches the vicinity of the flange of the bobbin, a tip surface of the second press block is generally flush with the main body tip surface of the first press block;

when the subsequent wound line body layer starts to be wound at the inner edge of the flange, the second press block protrudes from the main body tip surface of the first press block to press the outer circumferential surface of the previous wound line body layer by means of the tip surface of the second press block, and also a side surface of the second press block contacts a side surface of the line body winding part in the subsequent wound line body layer on a backward side in the traverse direction; and a traverse inversion signal transmission unit for, when the first press block is put on the subsequent wound line body layer at the inner edge of the flange, transmitting a traverse inversion signal; and the line body take-up method sets the take-up pitch to 1.01 to 1.25 times a width of the line body, wherein a cross-section of the line body has a substantially rectangular shape whose corners are rounded.

10. A line body take-up method according to claim 9, wherein the flange roller part has a structure of pressing the side surface of the line body winding part on the forward side in the traverse direction in an opposite direction to the traverse direction in the vicinity of the flange so that, when the line body winding part is inadvertently shifted in the traverse direction, the flange roller part contacts the side surface of the line body winding part on the forward side in the traverse direction and/or a space for winding the line body turn part is provided with certainty at the inner edge of the flange.

11. A line body take-up method according to claim 10, by which:

a position of each of the two flanges of the bobbin and a distance between the flanges is detected, and a traverse position formed of a start position at which the line body starts to be taken up and an inversion position at which the traverse direction is inverted is set based on results of the detection; and for taking up the line body wound around the outer circumferential surface of the winding body, the take-up pitch is set after a space for winding the line body turn part is provided with certainty.

12. A line body take-up method according to claim 9, by which:

a position of each of the two flanges of the bobbin and a distance between the flanges is detected, and a traverse position formed of a start position at which the line body starts to be taken up and an inversion position at which the traverse direction is inverted is set based on results of the detection; and for taking up the line body wound around the outer circumferential surface of the winding body, the take-up pitch is set after a space for winding the line body turn part is provided with certainty.

13. A line body take-up method according to claim 12, by which it is determined whether the bobbin is usable or not depending on whether the take-up pitch can be set to 1.01 to 1.25 times the width of the line body based on the traverse position and a size and a shape of the line body.

* * * * *